US007887308B2

(12) United States Patent
Navarro

(10) Patent No.: US 7,887,308 B2
(45) Date of Patent: Feb. 15, 2011

(54) VOLUMETRIC PUMP WITH RECIPROCATED AND ROTATED PISTON

(75) Inventor: Thierry Navarro, Gland (CH)

(73) Assignee: Swissinnov Product sarl (CH)

( * ) Notice: Subject to any disclaimer, the term of this patent is extended or adjusted under 35 U.S.C. 154(b) by 611 days.

(21) Appl. No.: 11/718,369

(22) PCT Filed: Aug. 12, 2005

(86) PCT No.: PCT/IB2005/002423

§ 371 (c)(1),
(2), (4) Date: May 1, 2007

(87) PCT Pub. No.: WO2006/056828

PCT Pub. Date: Jun. 1, 2006

(65) Prior Publication Data

US 2009/0053086 A1 Feb. 26, 2009

(30) Foreign Application Priority Data

Nov. 29, 2004 (WO) ..... PCT/IB2004/003906

(51) Int. Cl.
*F04B 37/00* (2006.01)

(52) U.S. Cl. ..... 417/461; 417/469; 417/218; 417/538

(58) Field of Classification Search ..... 417/257–258, 417/460–461, 464–465, 466, 538, 469; 91/216 R, 91/216 B, 217; 92/217
See application file for complete search history.

(56) References Cited

U.S. PATENT DOCUMENTS

| | | | | |
|---|---|---|---|---|
| 1,238,939 | A | 9/1917 | Pfleeger | |
| 1,548,981 | A * | 8/1925 | Clark | 417/538 |
| 2,517,645 | A | 8/1950 | Erikson | |
| 3,128,782 | A * | 4/1964 | Limpert et al. | 137/1 |
| 4,767,399 | A | 8/1988 | Bollish | |
| 4,850,980 | A | 7/1989 | Lentz et al. | |
| 5,312,233 | A | 5/1994 | Tanny et al. | |
| 6,358,023 | B1 * | 3/2002 | Guilmette | 417/460 |
| 6,793,471 | B2 * | 9/2004 | Latyshev | 417/460 |

(Continued)

FOREIGN PATENT DOCUMENTS

| | | |
|---|---|---|
| FR | 2668206 | 4/1992 |

(Continued)

*Primary Examiner*—Charles G Freay
*Assistant Examiner*—Todd D Jacobs
(74) *Attorney, Agent, or Firm*—Galbreath Law Offices, P.C.; John A. Galbreath

(57) ABSTRACT

A volumetric pump (1) comprising a piston (2) and a cylindrical chamber (3), contains an inlet port (10) and an outlet port (11). The piston (2) is actuated by a rotor (5) bearing an eccentric shaft (6). The shaft (6), being connected to the piston (2), causes the piston to slide back and forth inside the cylinder chamber (3) while having a bidirectional angular movement. The instroke of the piston (2) sucks a fluid (15) from the inlet port (10) through a first channel (12) into the pump chamber (3), the fluid being propelled through a second channel (13) to the outlet port (11) during the outstroke of the piston (2). The inlet (10) and outlet port (11) are opened and closed alternatively by the bidirectional angular movement of the piston (2) which acts as a valve for the inlet and outlet ports (10, 11).

13 Claims, 8 Drawing Sheets

U.S. PATENT DOCUMENTS

2003/0210996 A1* 11/2003 Latyshev ..... 417/460
2004/0101426 A1 5/2004 Wahlbert

FOREIGN PATENT DOCUMENTS

GB 860606 2/1961
GB 860616 * 2/1961
GB 2060131 4/1981
WO 95/08860 3/1995

* cited by examiner

*A-A*

*A-A*

*A-A*

*A-A*

*A-A*

VOLUMETRIC PUMP WITH RECIPROCATED AND ROTATED PISTON

BACKGROUND OF THE INVENTION

The present invention concerns a volumetric pump which may be used in different fields such as medical drug or fluid delivery (infusion Pump, IV pump, enteral pump, parenteral pump) or food, chemical or other industry, for example in conjunction with a compressor or an internal combustion engine.

Piston pumps with fluid modules are already part of the prior art. US 2004/101426 discloses a device comprising a cylindrical piston chamber whose upper and lower ends' profile have a specific gradient, said piston chamber containing a rotatable and axially movable pump piston. The profile of the upper and lower end surfaces of the piston has been determined to run concomitantly in contact with the respective two end surfaces of the chamber as the piston rotates. This rotation causes the piston to move alternately upwards and downwards permitting one-way suction and one-way propulsion of a fluid respectively into and out of the pump chambers. The rotational movement of the piston acts as a valve opening and closing alternately the inlet and outlet ports. The drawback of such system results essentially from the difficulties encountered when assembling the piston with the cylindrical chamber.

BRIEF SUMMARY OF THE INVENTION

GB 2060131, U.S. Pat. Nos. 4,767,399 and 4,850,980 disclose a pumping mechanism device whose suction and propulsion phases are achieved by means of a bidirectional linear movement of a piston inside a chamber. Unlike US 2004/101426, such pumping mechanism has a device acting as a valve on the inlet/outlet ports which is independent of the piston's movement. Accordingly, the movement of the valve as well as its synchronization with the piston's movement requires more parts thus increasing the cost of the pumping mechanism.

The aim of the present invention is to propose a low cost volumetric pump constituted of a reduced number of parts and having a trouble free assembly of the piston with the chamber.

This aim is achieved by a volumetric pump as set out in claim 1. This volumetric pump comprises at least one piston in a hollow cylinder, the pump having at least one inlet port through which a liquid can be sucked into a pump chamber during an instroke of said piston, and at least one outlet port through which the liquid can be expelled during an outstroke of the piston. The piston or the hollow cylinder can be actuated directly or indirectly by a rotor. This rotor transmits on the one hand a bi-directional linear movement to the piston or to the cylinder and on the other hand, a bi-directional angular movement either to the piston or to another rotable element in order to open and close alternately the inlet and outlet ports.

Unlike US 2004/101426, the combined bidirectional linear and angular movement transmitted by the rotor has for consequence to deliver a steady fluid rate of flow from the volumetric pump. Furthermore, this volumetric pump is highly accurate as the amount of fluid delivered by said pump is closely related to the relative position between the piston and the hollow cylinder housing.

BRIEF DESCRIPTION OF THE DRAWINGS

The invention will be better understood thanks to the following detailed description of several embodiments with reference to the attached drawings, in which.

DETAILED DESCRIPTION OF THE INVENTION

Figure 1:
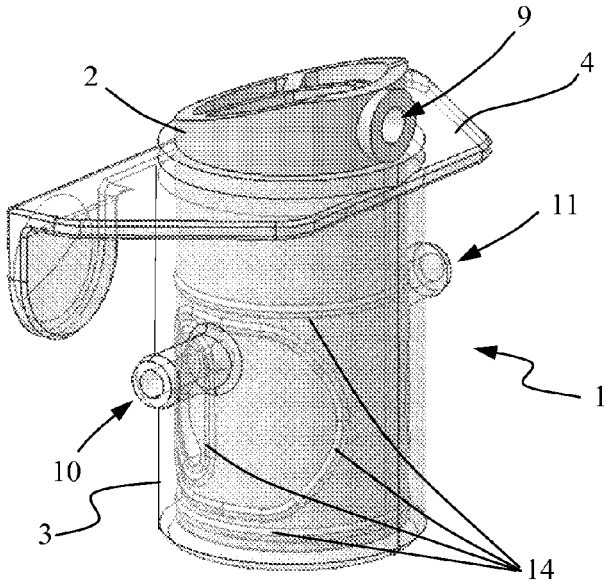
FIG. 1 is a perspective view of a volumetric pump with a piston located in a hollow cylinder according to a first embodiment of the invention, with the rotor removed
Figure 2:
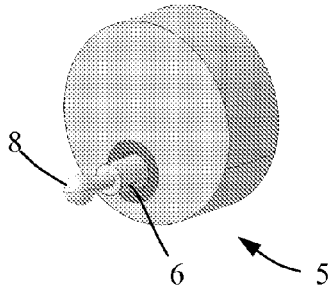
FIG. 2 is a perspective view of a rotor comprising an eccentric shaft of the first embodiment.

According to the preferred embodiment of the invention, FIG. 1 shows the volumetric pump (1) comprising a cylindrical piston (2) and a hollow cylinder (3) mounted on a support (4). This cylinder (3) has an upper open end wherein the piston (2) slidably fits. Piston (2) is actuated by a rotor (5) bearing an eccentric shaft (6) that is mounted on a spring (7).

Figure 3:
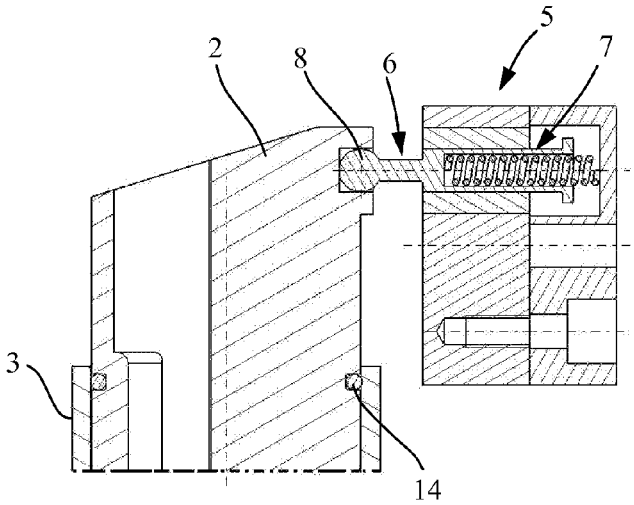
FIG. 3 is a cross-sectional view showing the engagement of this eccentric shaft in a receptacle adjacent the top of the piston.
Figure 3A:
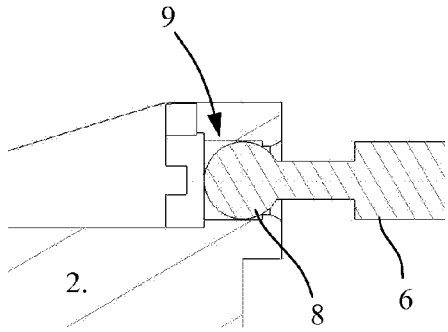
FIG. 3*a* shows a detail of FIG. 3.

As shown by FIG. 3 and FIG. 3*a*, the shaft (6) ends with a spherical extremity (8) which is clipped into a piston receptacle (9) in order to transform the angular motion of the rotor (5) into a bi-directional linear and angular movement of the piston (2). This piston (2) slides to and fro inside the cylinder (3) while having a bi-directional angular movement.

Figure 4:
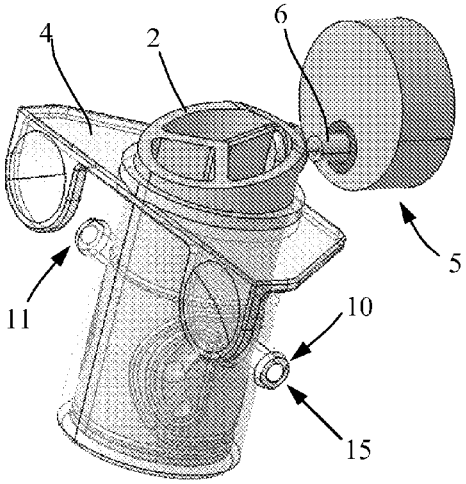
FIG. 4 is a perspective view of the first embodiment of volumetric pump at the beginning of a revolution cycle of the rotor.
Figure 4A:
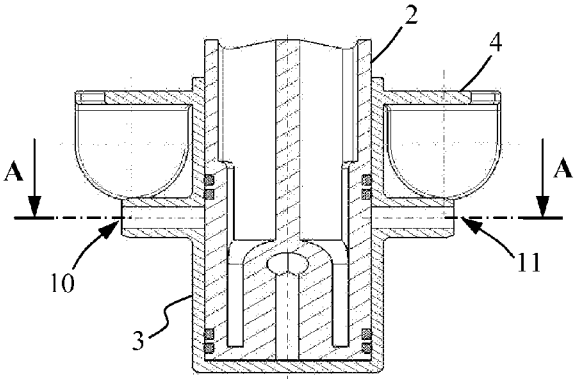
FIG. 4*a* is an axially sectioned rear view of FIG. 4
Figure 4B:
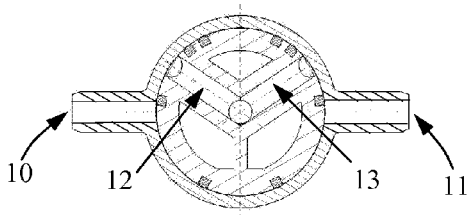
FIG. 4*b* is a cross-sectional view taken on the line A-A in FIG. 4*a*.
Figure 6:
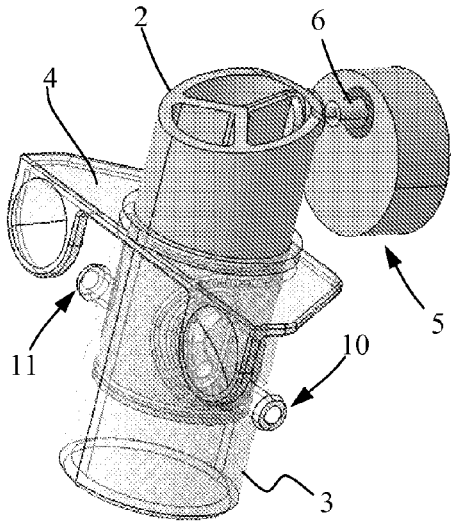
FIG. 6 is a perspective view the volumetric pump after a 180° rotation of the rotor.
Figure 6A:
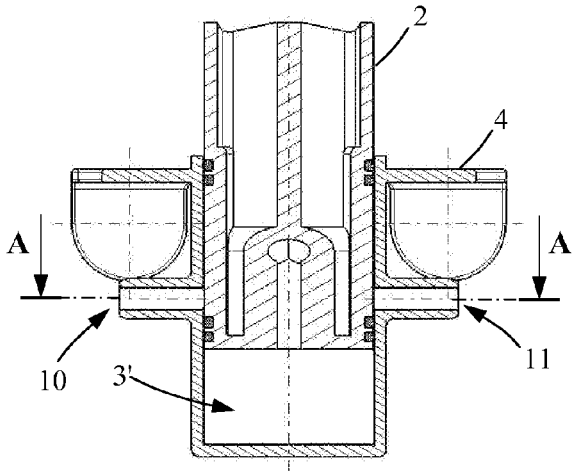
FIG. 6*a* is an axially sectioned rear view of FIG. 6
Figure 6B:
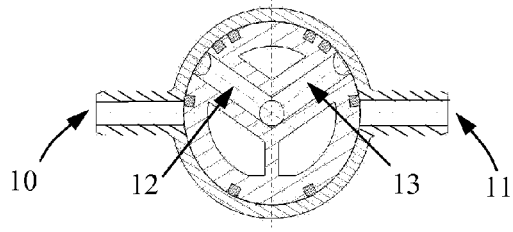
FIG. 6*b* is a cross-sectional view taken on the line A-A in FIG. 6*a*.

Shaft (6) transmits the movement of the piston (2) inside cylinder (3) as described below, while the spring (7) insures a smooth articulation of the extremity (8) inside the receptacle (9). Spring (7) is compressed when the piston (2) reaches the ends of the suction and propulsion strokes (FIG. 4 and FIG. 6).

When the piston (2) is in the suction or propulsion cycle (FIG. 5 and FIG. 7) spring (7) is relaxed.

Figure 5:
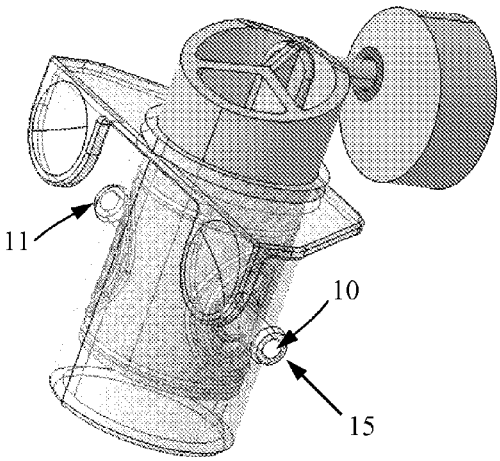
FIG. 5 is a perspective view of the volumetric pump after a 90° rotation of the rotor.
Figure 5A:
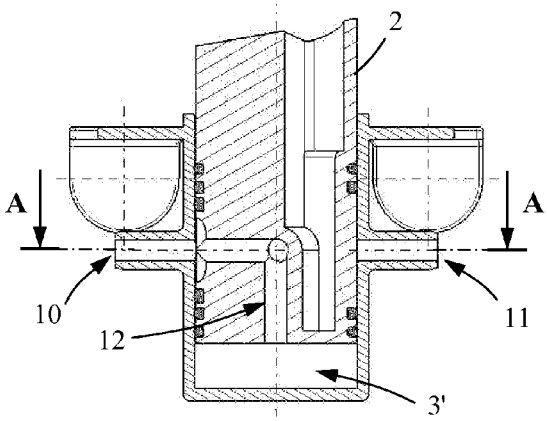
FIG. 5*a* is an axially sectioned rear view of FIG. 5
Figure 5B:
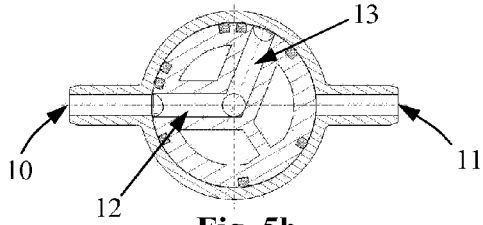
FIG. 5*b* is a cross-sectional view taken on the line A-A in FIG. 5*a*.
Figure 7:
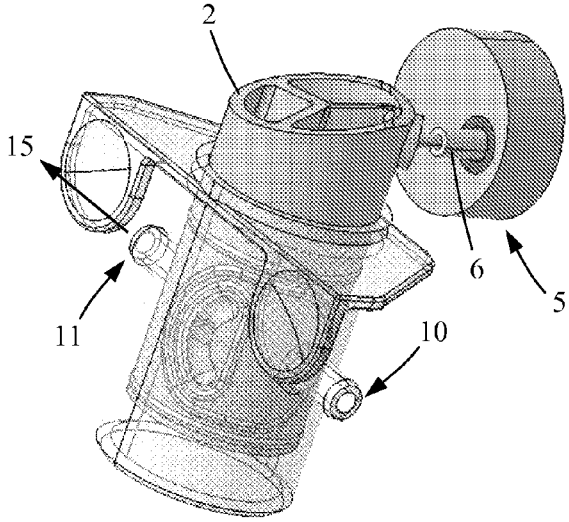
FIG. 7 is a perspective view of the volumetric pump after a 270° rotation of the rotor.
Figure 7A:
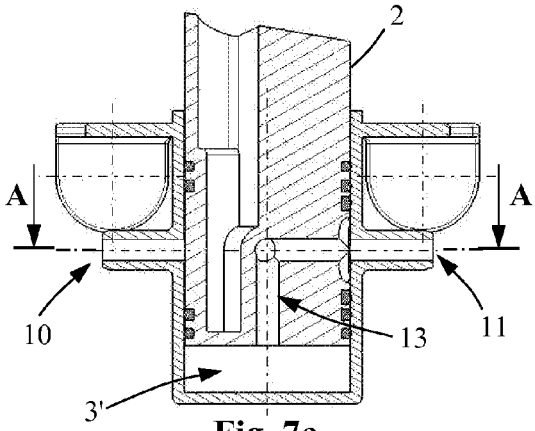
FIG. 7*a* is an axially sectioned rear view of FIG. 7
Figure 7B:
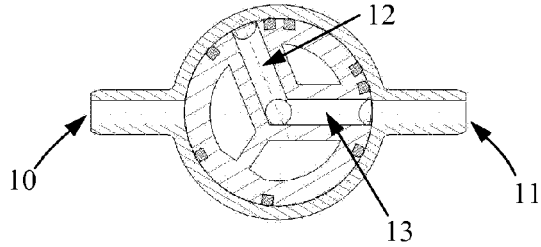
FIG. 7*b* is a cross-sectional view taken on the line A-A in FIG. 7*a*.

The bidirectional angular movement of the piston (2) acts as a valve for inlet and outlet ports (10, 11) that are located on opposite sides of the hollow cylinder (3). Piston (2) contains two channels (12,13), which cause the inlet port (10) and the outlet port (11) to open and close alternately while the piston (2) moves angularly. At first, the instroke (or upstroke) of the piston (2) opens the inlet port (10) and closes the outlet port (11), sucking a fluid (15) from the inlet port (10) through the first channel (12) into the lower part of the hollow cylinder (3) (FIG. 5*a* and FIG. 5*b*). Then, the outstroke (or down stroke) of the piston (2) closes the inlet port (10) and opens the outlet port (11), propelling the fluid (15) from said lower part of the pump chamber (3) through the second channel (13) to the outlet port (11) (FIG. 7*a* and FIG. 7*b*).

Said channels (12, 13) have been curve-shaped according to both bidirectional angular and linear movement of the piston (2) in order to ensure a constant opening of the inlet (10) and the outlet (11) during respectively the instroke phase and the outstroke phase of piston (2). This ensures a constant flow of liquid (15) from the inlet port (10) through the piston (2) to the lower part of the cylindrical chamber (3') during the instroke of piston (2) and a constant flow of the liquid (15) from the lower part of the pump chamber (3') to the outlet during the outstroke of the piston (2).

Several specifically shaped gaskets or standard Orings (14) are positioned around the inlet port (10) and the outlet port (11) in order to seal off the existing play between the external diameter of the piston (2) and the internal diameter of the cylindrical chamber (3'). Said gaskets, which comprise specific sealing rib design, are part of the piston (2) or cylinder (3).

The present invention may be adapted for medical use as a parenteral system. The piston (2) and the cylindrical chamber (3') can constitute a disposable. Unlike existing pumps with disposables composed by soft parts such as a flexible membrane or tube as in a peristaltic pump, the disposable piston (2) and cylindrical chamber (3') can be produced by injection molding methods as hard plastic parts and are therefore not influenced by pressure and temperature. As a result, such system allows an accurate release of a specific amount of a drug by a preset angular shift of the rotor (5). A single dose is produced by a 360° rotation of said rotor (5). Several doses can be released with such system at fixed intervals of time by simply actuating the rotor.

Figure 8:
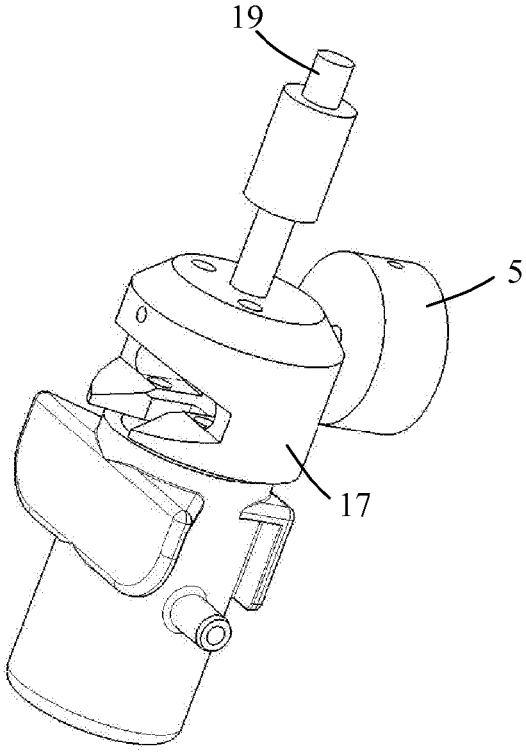
FIG. 8 is a perspective view of the volumetric pump according to a second embodiment of the invention comprising a piston head.
Figure 8A:
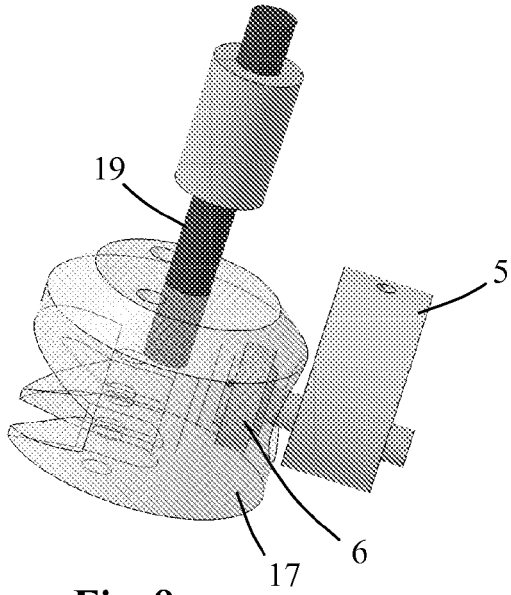
FIG. 8*a* is a perspective view of said piston head connected to the shaft of the rotor.
Figure 8B:
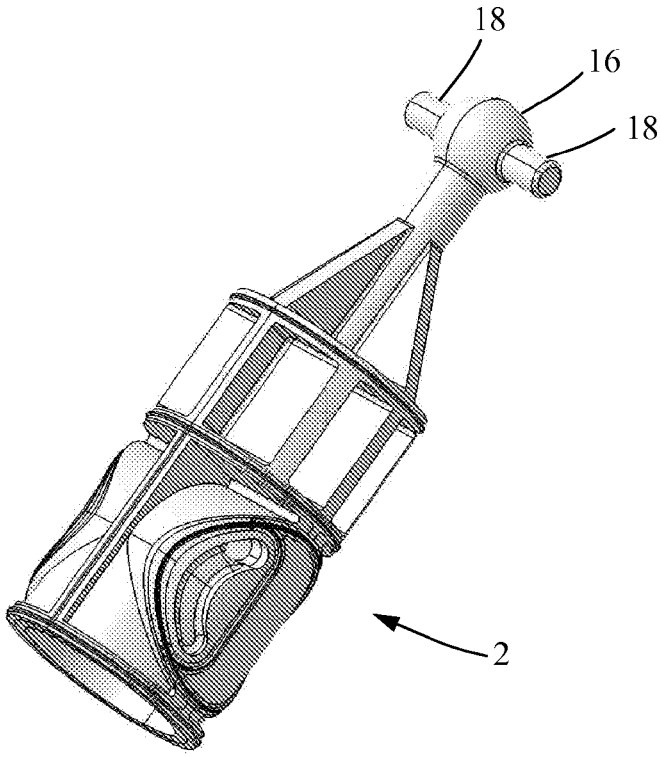
FIG. 8*b* is a perspective view of the piston of the second embodiment of the invention.

In the second embodiment of the present invention (FIG. 8, 8*a*), the upper-end of the piston (2) comprises a ball-and-socket joint (16) which is firmly connected to a piston head (17) through two lugs (18). The rotor (5) bearing the eccentric shaft (6) transmits through piston head (17) a combined bidirectional angular and linear movement to the piston (2), the piston head (17) having a hole into which a shaft (19) is driven in for guidance. Such embodiment avoids abutment which may occur in the first embodiment of the present invention between the spherical extremity (8) of the shaft (6) and the piston receptacle (9) when the piston (2) is in the suction or propulsion cycle as shown by FIG. 5 and FIG. 7.

Figure 9:
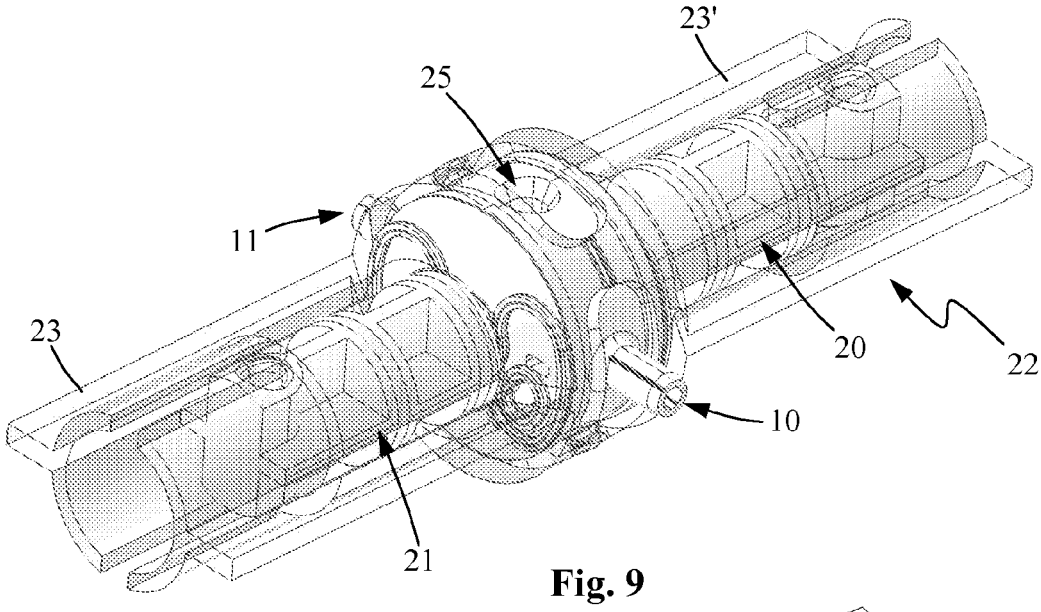
FIG. 9 is a perspective top view of the volumetric pump according to a third embodiment of the present invention showing the pump in transparency without the rotor.
Figure 9A:
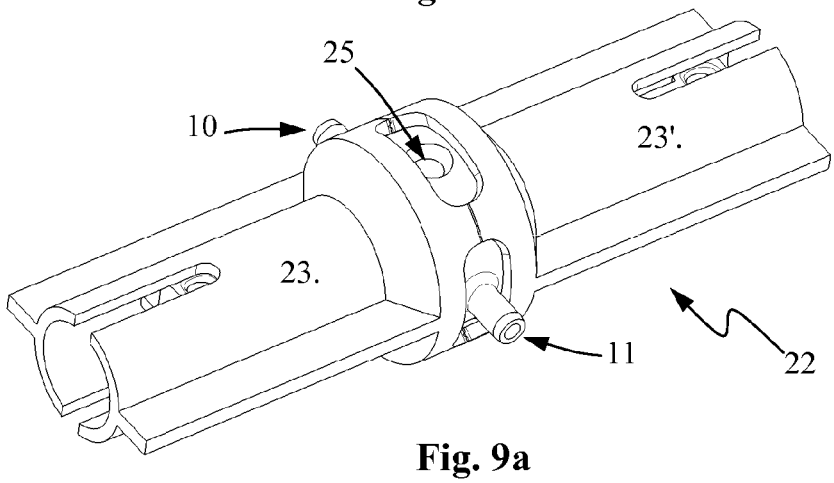
FIG. 9*a* is a perspective bottom view of the third embodiment showing the outside of the volumetric pump without the rotor.
Figure 14A:
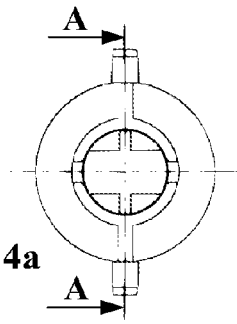
FIG. 14*a* is an end view of FIG. 9 and FIG. 14*b* a cross-sectional view taken on the line A-A in FIG. 14*a* after 180° rotation of the rotor.
Figure 14B:
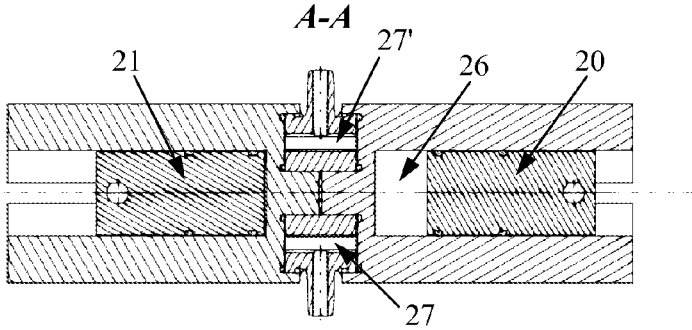
Figure 15A:
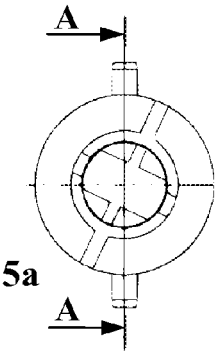
FIG. 15*a* is an end view of FIG. 9 and FIG. 15*b* a cross-sectional view taken on the line A-A in FIG. 15*a* after 270° rotation of the rotor.
Figure 15B:
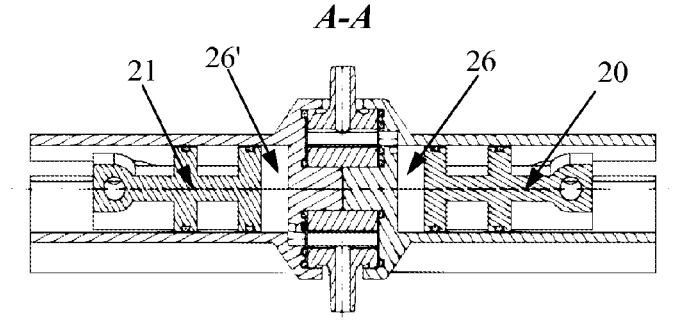

In the third embodiment, (FIGS. 9 to 15), a first and a second piston (20, 21) are fixedly positioned opposite to each other inside a hollow cylindrical mobile housing (22) as shown by FIG. 9. Said housing (22) is made up of two identical cylindrical parts (23, 23') assembled end-to-end facing each other. A disc (24) (FIGS. 10*a*, 11, 11*a*) comprising the inlet and outlet ports (10, 11) located preferably laterally at 180° from each other and a hole (25) on its underneath part (FIG. 9*a*), is mounted midway inside said housing (22) between the two cylindrical parts (23, 23'). Such assembling creates a first and a second chamber (26, 26') (FIG. 12*b*, 14*b*). The disc (24) is angularly movable relative to the housing (22) formed by parts (23, 23').

A shaft (not shown) is inserted into the hole (25), said shaft being mounted on a rotor (5), as described in the first embodiment of the invention, for transmitting to the disc (24) a combined bi-directional linear and angular movement.

Such movement of the disc (24) causes the cylindrical housing (22) to slide back and forth following the axis of the two pistons (20, 21) while closing the inlet and outlet ports (10, 11) so as to ensure on the one hand an alternate sucking of the fluid (15) from the inlet port (10) to respectively the first and second chamber (26, 26') and on the other hand an alternate expelling of the fluid (15) from respectively the first and second chambers (26, 26') to the outlet port (11).

Figure 10:
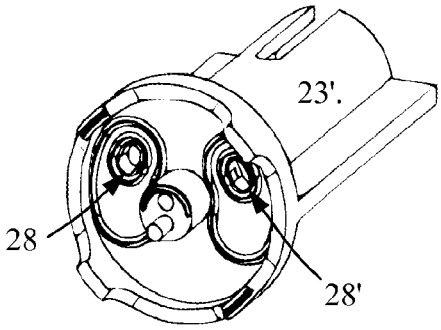
FIG. 10 is a perspective view of one of the two cylindrical parts constituting the hollow cylindrical housing of the third embodiment.
Figure 10A:
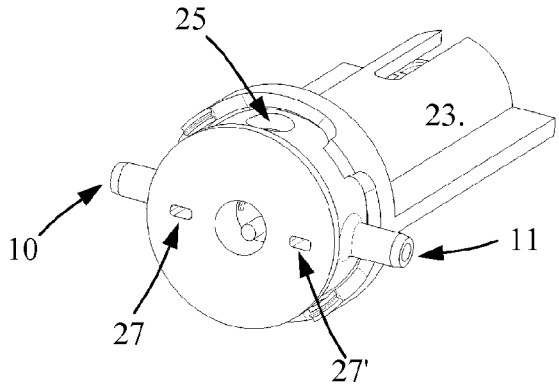
FIG. 10*a* is a perspective view of another rotable element fitted into the cylindrical part of FIG. 10.
Figure 11:
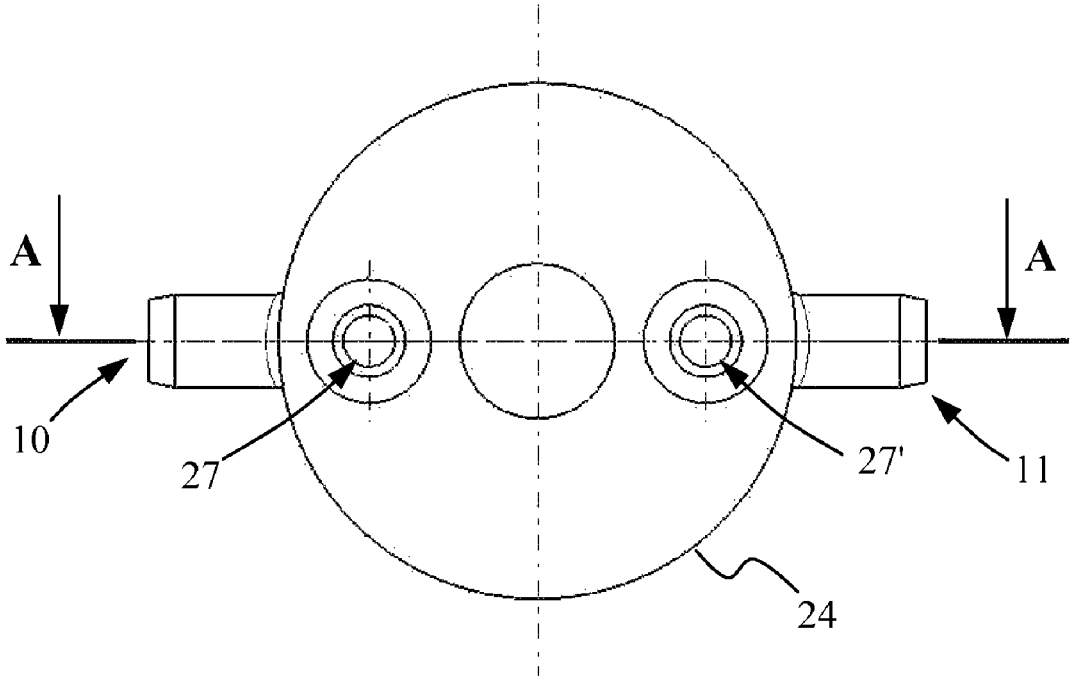
FIG. 11 is a front view of this rotable element and FIG. 11*a* a cross-sectional view of said element taken on the line A-A in FIG. 11.
Figure 11A:
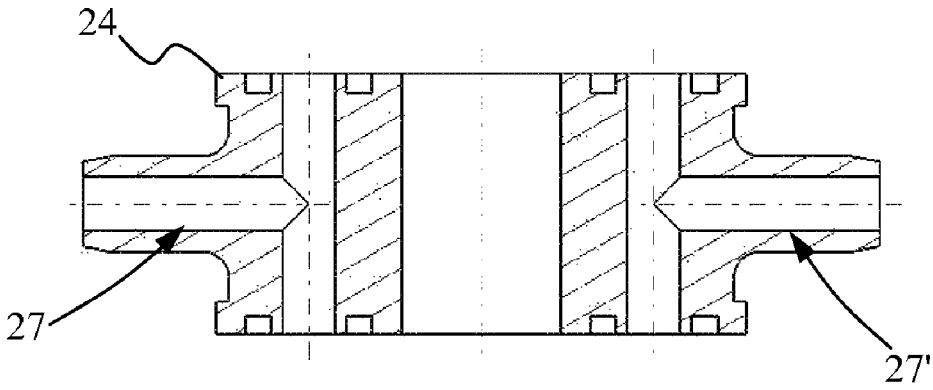
Figure 12A:
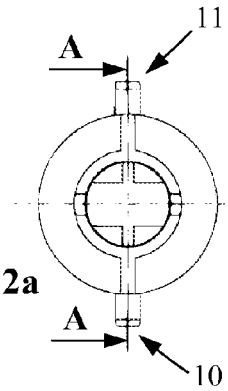
FIG. 12*a* is an end view of FIG. 9 and FIG. 12*b* a cross-sectional view taken on the line A-A in FIG. 12*a* at the beginning of a cycle.
Figure 12B:
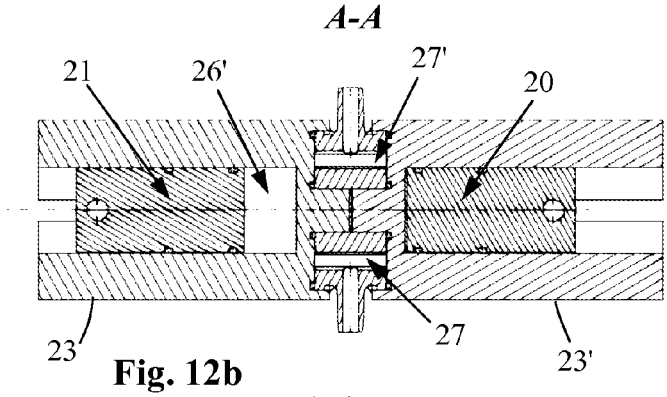
Figure 13A:
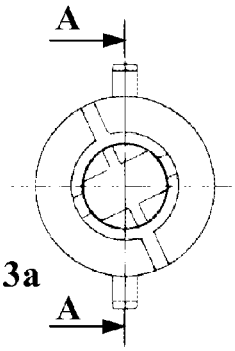
FIG. 13*a* is an end view of FIG. 9 and FIG. 13*b* a cross-sectional view taken on the line A-A in FIG. 13*a* after a 90° rotation of the rotor.
Figure 13B:
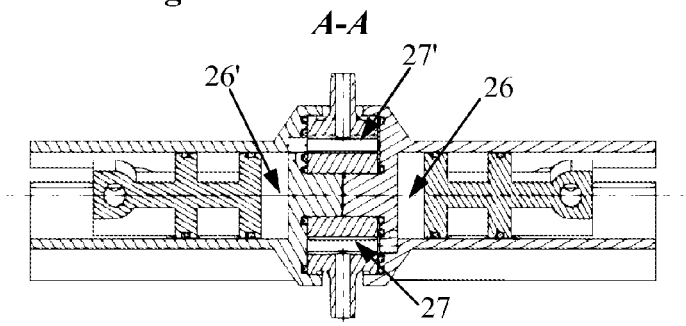

The optimum synchronization of the suction and propulsion phases between the two chambers (26, 26') is achieved by a first and a second T-shaped channel (27, 27') located inside the disc (24) and in its inlet/outlet as shown by FIG. 11*a*. Channels (27, 27') connect alternately the inlet port (10) to the first and second chambers (26, 26',) and the first and the second chamber (26, 26') to the outlet port (11) when said channels (27, 27') overlap alternately the first and the second opening (28, 28') located on the end of both cylindrical parts (23, 23') (FIG. 10). This particular embodiment of the invention allows the volumetric pump to provide a continuous flow.

Figure 16:
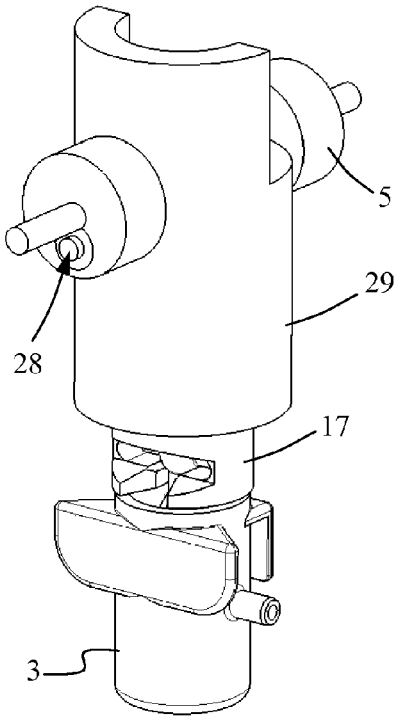
FIG. 16 is a perspective view of the volumetric pump according to a fourth embodiment of the invention.
Figure 16A:
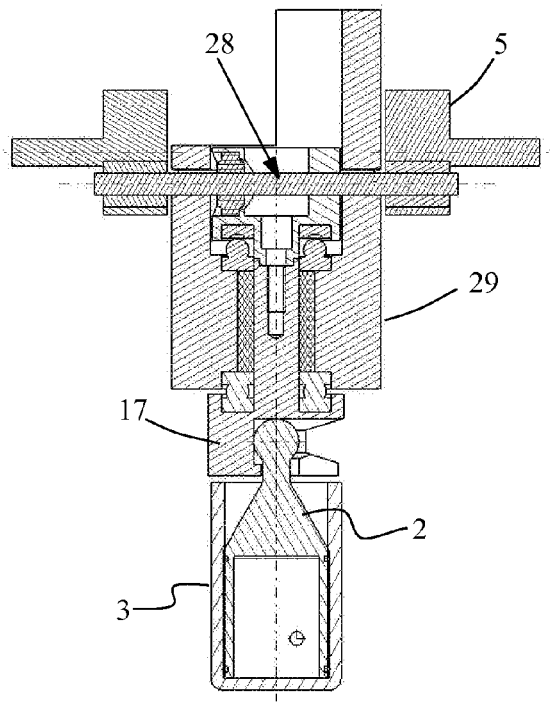
FIG. 16*a* is an axially sectioned view of FIG. 16 taken along an axe connected to a least one rotor.

In a fourth embodiment of the invention, the combined bidirectional linear and angular movement of the piston (2) is imparted by mean of an axe (28) which passes through an upper part (29) rigidly connected with the piston head (17) as shown by FIGS. 16 and 16*a*. Said axe (28) can be actuated by at least one rotor (5). The movement of the axe (28) transmits to the piston (2) a movement such as described in the second embodiment of the invention.

Figure 17:
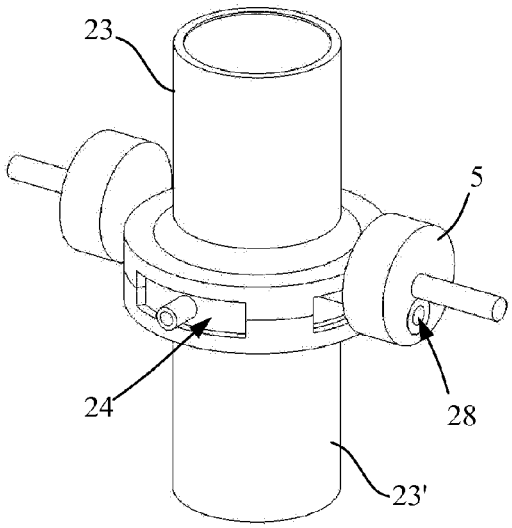
FIG. 17 is a perspective view of the volumetric pump according to a further embodiment of the invention.
Figure 17A:
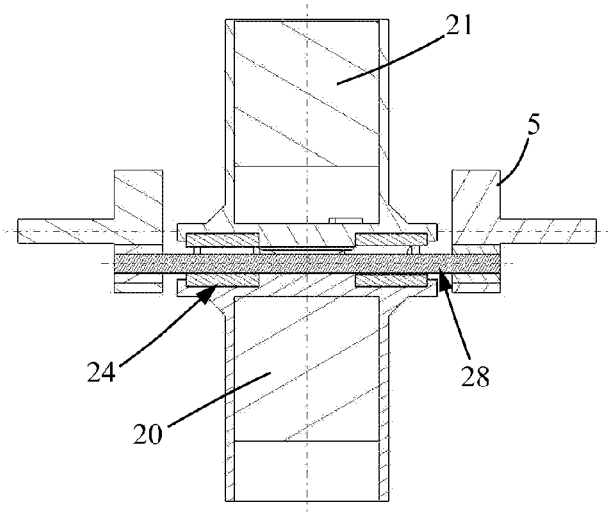
FIG. 17*a* is an axially sectioned view of FIG. 17 taken along an axe connected to at least one rotor.

Such transmission can be adapted to the third embodiment of the invention (FIGS. 17 and 17*a*).

In a further embodiment of the present invention (not shown in the drawings), the pump (1) is actuated by two rotors (5, 5') operatively connected to the upper and lower parts of said piston (2) as described in the first embodiment. The first rotor (5) transmits to the piston (2) the movement required by the suction phase while the second rotor (5') transmits to said piston (2) the movement required by the propulsion phase.

All embodiments of the present invention can be adapted so as to dissociate the relative linear movement of the piston with its angular movement. The linear movement can be transmitted by a first rotor and the angular movement can be transmitted by a second rotor. The movement of the piston can be converted from a linear movement to an angular movement at any time of its stroke.

In another variant of the present invention, the pump (1) can be used as a compressor. A sealed tight tank can be fitted on the outlet port, sucking the air through the inlet (10) into the chamber and propelling the air into the tank by the same mechanism described in the first embodiment.

The mechanism of this volumetric pump (1) can also be adapted for an internal combustion engine. Thus, another aspect of the invention is an internal combustion engine comprising a volumetric pump according to the invention, as described herein.

Although the present invention has been described with reference to specific embodiments, this description is not meant to be construed in limiting sense. Various other fields of application of the invention can be contemplated without departing from the scope of the invention as defined in the appended claims.

The invention claimed is:

1. A volumetric pump comprising at least one first piston inside a first hollow cylindrical part, said pump having at least one inlet port through which a liquid can be sucked into at least one pump chamber during an instroke of said first piston, and at least one outlet port through which the liquid can be expelled during an outstroke of the first piston, the pump further comprising at least one second piston which is positioned opposite to the first piston inside a second hollow cylindrical part to create a second pump chamber through which the liquid can be sucked in through an inlet port during an instroke of the second piston and expelled through an outlet port during an outstroke of said second piston, both cylindrical parts of the pump being assembled end-to-end facing each other to form a housing, wherein a disc, that comprises the inlet and outlet ports, is mounted midway inside said housing, and is arranged to be animated by a combined bidirectional linear and angular movement, to cause relative to-and-fro sliding between the housing and the pistons along the axis of said pistons to produce said instrokes and outstrokes of the first and second pistons, whereas rotation of the disc relative to the housing is arranged to close the inlet and outlet ports synchronically to ensure a continuous flow delivery.

2. A volumetric pump according to claim 1, characterized in that the housing is fixed, while the first and second pistons are slidable inside said housing.

3. A volumetric pump according to claim 1, wherein said pistons, disc and housing are disposables.

4. A compressor comprising a tank that is sealed tight to the outlet port of the volumetric pump according to claim 1.

5. A volumetric pump according to claim 2, characterized in that the disc is arranged to be animated by a bidirectional linear movement.

6. A volumetric pump according to claim 2, comprising means to dissociate the linear movement of the pistons from the angular movement of the disc.

7. A volumetric pump according to claim 1, wherein a first T-shaped channel and a second T-shaped channel are located inside the disc, said channels cooperating with a first and second openings located on the end of both cylindrical parts adjacent the sides of the disc, in order to connect alternately the inlet port to the first and second chambers, and the first and second chambers to the outlet port when said channels overlap alternately said first and second openings.

8. A volumetric pump according to claim 1, wherein the disc comprises a hole on its underneath part adapted to receive a shaft of a driving member that is eccentrically mounted on a rotor.

9. A volumetric pump according to claim 1, wherein said first and second pistons are injection molded parts.

10. A volumetric pump according to claim 7, wherein specific gaskets or standard O-rings are positioned on the disc around the way out of the T-shaped channels and around the first and second openings located on the end of both cylindrical parts adjacent the sides of said disc.

11. A volumetric pump according to claim 1, wherein the pump is an enteral pump.

12. A volumetric pump according to claim 1, wherein the pump is a parentaral pump.

13. A volumetric pump according to claim 1, wherein the first and second pistons are fixedly positioned inside the housing, said housing being slidable following the axis of the two pistons.

* * * * *